US006710692B2

(12) United States Patent
Kato et al.

(10) Patent No.: US 6,710,692 B2
(45) Date of Patent: Mar. 23, 2004

(54) COIL COMPONENT AND METHOD FOR MANUFACTURING THE SAME

(75) Inventors: Hidekazu Kato, Machida (JP); Takahiro Aoki, Machida (JP); Hiroyuki Yasuzawa, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/076,373

(22) Filed: Feb. 19, 2002

(65) Prior Publication Data

US 2002/0113680 A1 Aug. 22, 2002

(30) Foreign Application Priority Data

Feb. 19, 2001 (JP) ..... 2001-042490

(51) Int. Cl.[7] ..... H01F 27/02
(52) U.S. Cl. ..... 336/83; 336/200; 336/233
(58) Field of Search ..... 336/83, 199, 200, 336/206–208, 223, 232, 233, 98, 90.96; 29/602.1

(56) References Cited

U.S. PATENT DOCUMENTS 6,373,368 B1 * 4/2002 Shikama et al. ..... 336/200
6,392,525 B1 * 5/2002 Kato et al. ..... 336/233
6,529,109 B1 * 3/2003 Shikama et al. ..... 336/83

FOREIGN PATENT DOCUMENTS

JP 62-13005 1/1987

* cited by examiner

*Primary Examiner*—Tuyen T. Nguyen
(74) *Attorney, Agent, or Firm*—Keating & Bennett, LLP

(57) ABSTRACT

After an air-core coil has been set inside a molding die, the molding die is filled with a magnetic powder which is coated with at least two types of resin layers. A pure iron powder having an average particle size of about 20 $\mu$m or less is desirable for the magnetic powder. A thermosetting resin is used for the inner resin layer and a thermoplastic resin is used for the outer resin layer of the resin layers of two kinds with which the surface of the magnetic powder is coated. Then, a substantially rectangular molded body in which the air-core coil is embedded is formed by molding the magnetic powder under a molding pressure of about 1 to about 10 tons/cm$^2$. Next, a magnetic body is formed by heat-treatment of the molded body.

10 Claims, 5 Drawing Sheets

COIL COMPONENT AND METHOD FOR MANUFACTURING THE SAME

BACKGROUND OF THE INVENTION

1. Field of the Invention

The present invention relates to a coil component and its manufacturing method.

2. Description of the Related Art

A conventional coil component is manufactured by setting an air-core coil inside of a molding die, filling the molding die with mixed powders of magnetic powder and a binder or magnetic powder coated with a resin, and molding the coil component under pressure.

However, when the mixed powders of magnetic powder and a binder are used, it is difficult to uniformly mix the magnetic powder and the binder. As a result, it is difficult to obtain sufficient insulating properties in a resulting magnetic body, and accordingly, substantial current loss occurs. Furthermore, when the amount of the binder as compared to the magnetic powder is reduced in order to improve the magnetic characteristics of the coil component, the mixed powders of magnetic powder and a binder become non-uniform masses, and thus, it is difficult to fill the molding die with the mixed powders. Therefore, the density of the molded magnetic body is decreased, and thus, stable magnetic characteristics cannot be obtained and the mechanical strength is substantially reduced.

Furthermore, when a magnetic powder coated with only a resin is used, when the molding pressure is increased in order to reduce the space between magnetic particles, the resin breaks, and thus, sufficient insulating properties are not obtained in the magnetic body.

SUMMARY OF THE INVENTION

In order to overcome the above-described problems, preferred embodiments of the present invention provide a coil component having excellent insulating properties and magnetic characteristics and greatly increased mechanical strength, and also provide a method of manufacturing such a novel a coil component.

According to a preferred embodiment of the present invention, a coil component includes a magnetic body made of magnetic powder, the surface of the magnetic powder is coated with at least two different types of resin layers, and a coil defined by a conductor having an insulating film provided thereon, at least a portion of which is embedded in the magnetic body. Here, a magnetic metal powder, for example, a pure iron powder, an amorphous powder, and a Sendust powder, is used for the magnetic powder.

Furthermore, a method for manufacturing a coil component according to another preferred embodiment of the present invention includes the steps of setting a coil component made of a conductor having an insulating film provided thereon in a mold, filling the mold with a magnetic powder, the surface of the magnetic powder being coated with at least two types of resin layers, pressing the magnetic powder to form a molded body in which the coil is embedded, and forming a magnetic body by heat-treating the molded body.

With the unique construction described above, even if the molding pressure is increased and heat-treatment is performed after the molding, breakdown of the inner resin layer is prevented and outstanding insulation between magnetic particles is achieved by using, for example, a thermosetting resin having a high mechanical strength for the inner resin layer. Moreover, the insulation between magnetic particles is further improved by providing an oxide film at the interface between the resin layer and the magnetic powder.

Further, by using, for example, a thermoplastic resin for the outer resin layer, the outer layer of the resin layers temporarily melts and then solidifies again when heat-treatment is performed after the molding, the bonding strength between magnetic particles greatly increases, and the space between magnetic particles is greatly reduced. As a result, the mechanical strength of the magnetic body is greatly increased.

Moreover, by using a thermosetting resin for the outer resin layer that is different from that of the inner resin layer, the outer resin layer that is not yet cured is completely cured by heat-treatment after the molding, the bonding strength between magnetic particles is greatly increased, and the space between magnetic particles is greatly reduced. As a result, the mechanical strength of the magnetic body is greatly increased.

Furthermore, the insulating properties and the mechanical strength of the magnetic body are greatly improved by providing a coating material made of either resin or glass on the surface of the magnetic body.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, preferred embodiments of a coil component and a manufacturing method thereof according to the present invention will be described with reference to the accompanying drawings.

Figure 1:
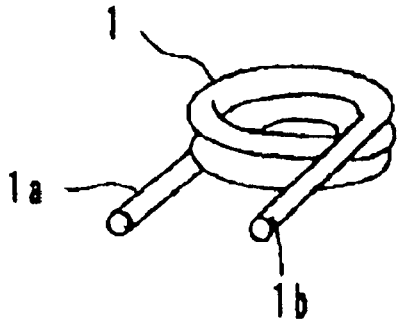
FIG. 1 is a perspective view showing a coil component of a first preferred embodiment according to the present invention.

As shown in FIG. 1, an air-core coil 1 according to a first preferred embodiment of the present invention is preferably formed by winding a conductor having an insulating coating, such as polyurethane, thereon to form a coil. The conductor is preferably made of copper, silver, gold, or other suitable material, and may have any suitable cross-section, such as a substantially round shape or a substantially square shape. However, in the present preferred embodiment, a conductor having a substantially round cross-section is preferably used.

Next, after the air-core coil 1 has been set in a mold, the mold is filled with a magnetic powder that is coated with two types of resin layers. Pure iron particles having an average particle size of about 20 $\mu$m or less are preferable for the magnetic powder. The pure iron particles have a saturation magnetic flux density of about 1.5 to about 2.0 T, and are easily deformed and molded, and further, the material is low-cost. Additionally, when the average particle size of the pure iron particles is about 20 $\mu$m or less (typical value: about 10 $\mu$m), a magnetic body having excellent characteristics in the switching frequency band (100 kHz to 3 MHz), and particularly in the inductance characteristic is obtained.

Figure 13:
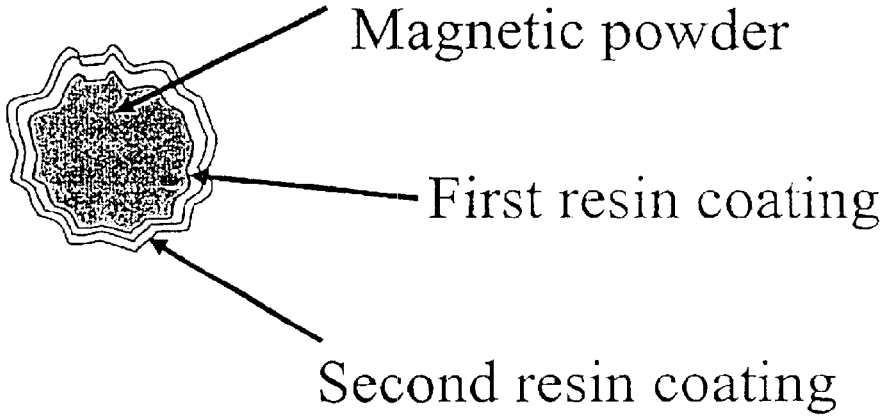
FIG. 13. illustrates a megnetic particle according to a preferred embodiment of the present invention.

An oxide film is provided on the surface of the magnetic particles by oxidation treatment or exposure under natural conditions in order to acquire insulating properties. However, the oxide film is not necessarily required. The two types of resin layers are provided on this oxide film as shown in FIG. 13.

A thermosetting resin is preferably used for the inner layer, and a thermoplastic resin is preferably used for the outer layer of the two types of resin layers. In the first preferred embodiment, a thermosetting fluororesin (about 1.5 wt % of the magnetic particles) is preferably used for the thermosetting resin, and a thermoplastic polyimide resin (about 0.5 wt % of the magnetic particles) is preferably used for the thermoplastic resin Moreover, a thermosetting resin is used the inner layer, and a thermosetting resin having a different composition from that of the inner layer may be used for the outer layer. More specifically, for example, thermosetting fluororesin (about 1.5 wt %) is used for the inner layer, and thermosetting epoxy resin (about 0.5 wt %) is used for the outer layer. Initially, the outer layer is not hardened, and the outer layer is completely hardened by heat-treatment after the molding (to be described below). The heat-treatment is performed at about 150 to about 250° C. Thus, the bonding strength between magnetic particles greatly increases, and the mechanical strength of the magnetic body greatly increases. However, the outer layer may be partially hardened before the heat-treatment, as long as the majority of the outer layer is not hardened before heat-treatment.

The inner layer is preferably in the range of about 1.0 wt % to about 3.0 wt %. When the inner layer is less than about 1.0 wt %, insulation between magnetic particles in the molded body is not sufficiently achieved, and when the inner layer exceeds about 3.0 wt %, since the molding density decreases, stable magnetic characteristics are not obtained. Furthermore, the outer layer is preferably in the range of about 0.5 wt % to about 1.0 wt %. When the outer layer is less than about 0.5 wt %, sufficient mechanical strength of the molded body is not obtained, and when the outer layer exceeds about 1.0 wt %, since the molding density decreases, stable magnetic characteristics are not obtained.

When the inner layer is in the range of about 1.0 wt % to about 3.0 wt %, its thickness is about 0.05 $\mu$m to about 0.2 $\mu$m. For example, when the inner layer is about 1.5 wt %, the thickness is about 0.1 $\mu$m. On the other hand, when the outer layer is in the range of about 0.5 wt % to about 1.0 wt %, its thickness is about 0.02 $\mu$m to about 0.05 $\mu$m. For example, when the outer layer is about 0.5 wt %, the thickness is about 0.02 $\mu$m. Furthermore, the outer layer is preferably thinner than the inner layer. If the outer layer is thicker than the inner layer, when the heat-treatment is performed after the molding, the inner stress is reduced within the molded body and, as a result, the dimensional accuracy deteriorates. Regarding the inner layer, a minimum thickness is required in order to produce the necessary insulating properties in the molded body.

Figure 2:
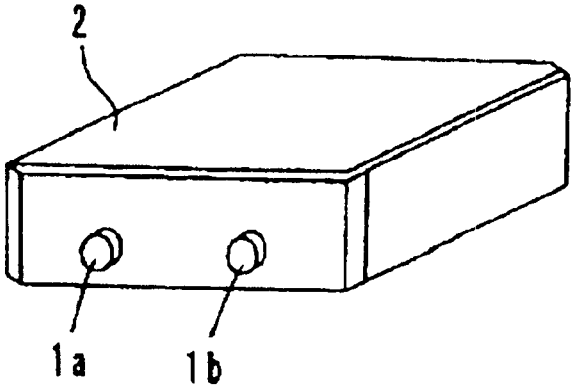
FIG. 2 is a perspective view showing a molded body to describe a manufacturing step which follows that shown in FIG. 1.

As shown in FIG. 2, a substantially rectangular molded body 2, in which the air-core coil 1 is embedded, is formed of the magnetic powder under a pressure of about 1 tons/cm$^2$ to about 10 tons/cm$^2$. The end portions 1*a* and 1*b* of the air-core coil 1 extend from the side surface of the molded body 2. Next, the molded body 2 is heat treated to form the magnetic body 2*a* (for example, the heat-treatment is performed at about 200° C. to about 250° C. when thermoplastic polyimide resin is used). In the heat-treatment, after the thermoplastic resin of the outer layer is temporarily melted, the resin is solidified again, the bonding strength between magnetic particles greatly increases, and the space between magnetic particles greatly decreases. In this way, for example, the density of the magnetic body 2*a* is about 4 g/cm$^3$ to about 7 g/cm$^3$. As a result, the mechanical strength of the magnetic body 2*a* increases to be at least 120 Kg/cm$^2$, and airtight characteristics and weather resistance are greatly improved.

Furthermore, low-viscosity resins (for example, thermosetting resins or ultraviolet-curing resins) and coating glass materials are provided on the surface of the magnetic body 2*a*, and heat-treatment and ultraviolet radiation are performed to further improve the insulation and mechanical strength of the magnetic body.

Figure 3:
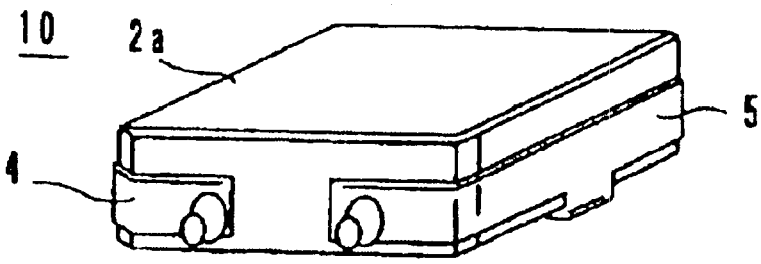
FIG. 3 is a perspective view showing a magnetic body of the coil component to describe a manufacturing step which follows that shown in FIG. 2.

Next, as shown in FIG. 3, metal terminals 4 and 5 are provided on the magnetic body 2*a*. The end portions 1*a* and 1*b* of the air-core coil 1 are electrically connected to the metal terminals 4 and 5 by welding, soldering, conductive adhesive, or other suitable method.

In a choke coil 10 obtained by this method, since a thermosetting resin having a mechanical strength that is greater than an upper thermoplastic resin is provided under the thermoplastic resin layer, even if the molding pressure is increased at the time of molding and heat-treatment is carried out after the molding, the inner resin layer does not break down and the insulation between magnetic particles (the resistivity is at least about $10^5$ Ω·cm) is provided. Moreover, since an oxide film is provided at the interface between the magnetic powder and the resin layers, the insulation between magnetic particles is further improved.

Specifically, an example of the choke coil 10 having approximate dimensions of 12.5 mm×12.5 mm×3.5 mm) was produced by using an air-core coil 1 having 4.75 turns, an inner diameter of about 5.2 mm, and a wire diameter of about 0.9 mm and by setting the molding pressure at about 2.0 tons/cm$^2$ when pressing and the molding (pressing) time at 3 sec, and an evaluation of characteristics of the choke coil 10 was conducted and shown as follows:

Rated current/temperature rise: 15 A/60.4° C.

Inductance value at rated current: 1.1 $\mu$H (Initial inductance value: 1.3 $\mu$H, and inductance value at current of 20 A: about 1.0 $\mu$H)

Direct-current resistance value: 2.97 mΩ.

Figure 4:
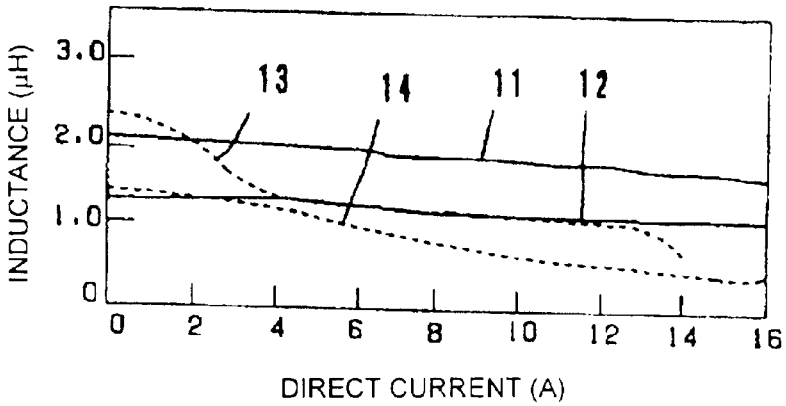
FIG. 4 is a graph showing direct-current superposed characteristics of the coil component shown in FIG. 3.

Furthermore, FIG. 4 is a graph showing direct-current superposed characteristics of the choke coils 10. The solid line 11 shows the characteristic of a choke coil 10 produced at a molding pressure of about 8.4 tons/cm$^2$, and the solid line 12 shows the characteristic of a choke coil 10 produced at a molding pressure of about 2.0 tons/cm$^2$. Moreover, in FIG. 4, the characteristics of conventional choke coils are also shown for comparison (see broken lines 13 and 14).

Figure 5:
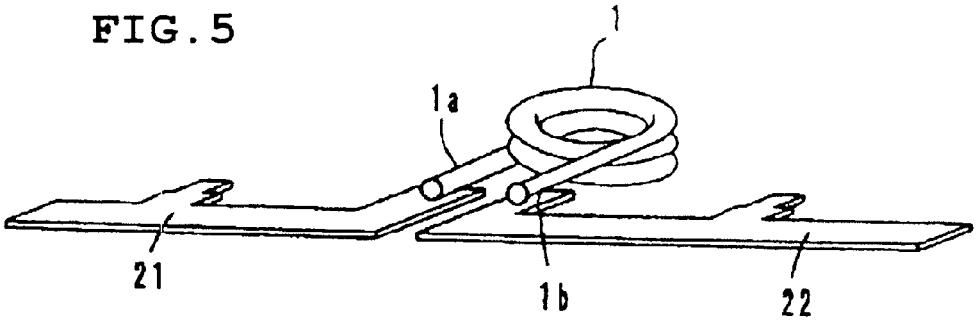
FIG. 5 is a perspective view showing a coil component of a second preferred embodiment according to the present invention.
Figure 6:
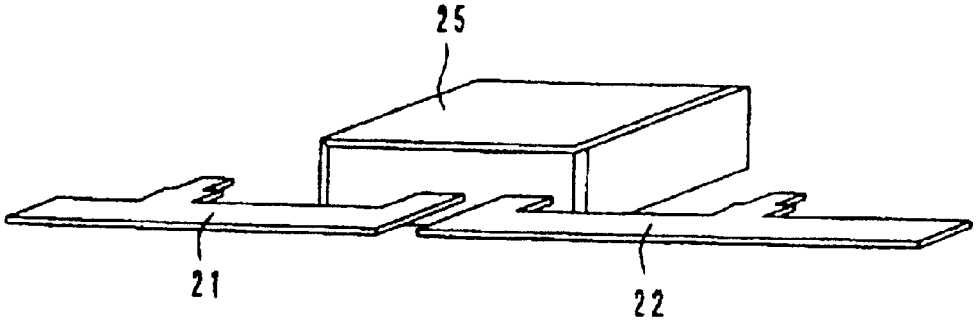
FIG. 6 is a perspective view showing a molded body to describe a manufacturing step which follows that shown in FIG. 5.
Figure 7:
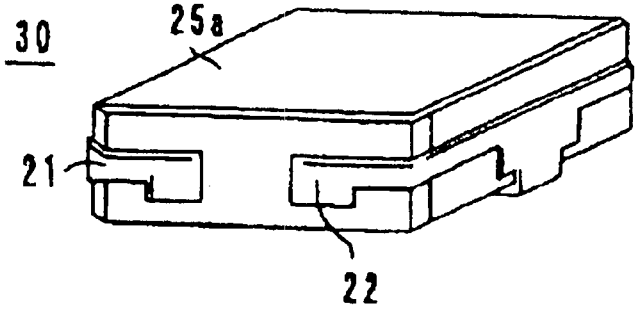
FIG. 7 is a perspective view showing a magnetic body of the coil component to describe a manufacturing step which follows that shown in FIG. 6.
Figure 8:
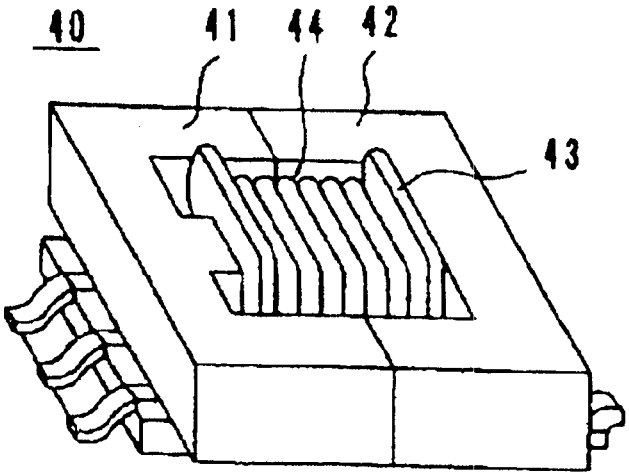
FIG. 8 is a perspective view showing a coil component of another preferred embodiment according to the present invention.
Figure 9:
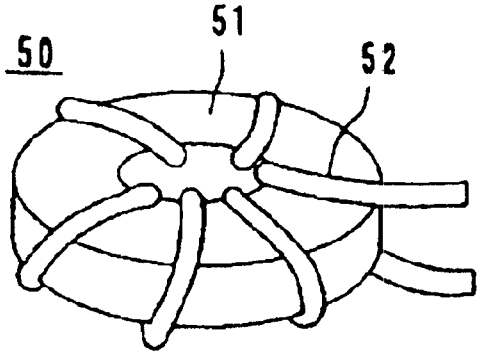
FIG. 9 is a perspective view showing a coil component of another preferred embodiment according to the present invention.
Figure 10:
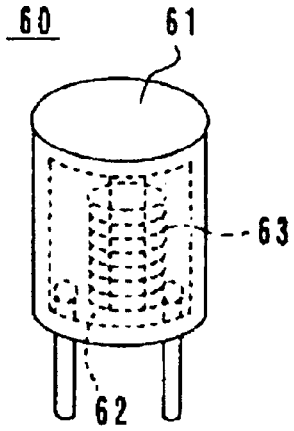
FIG. 10 is a perspective view showing a coil component of another preferred embodiment according to the present invention.

In a choke coil according to second preferred embodiment, as shown in FIG. 5, after the end portions 1*a* and 1*b* of the air-core coil 1 have been electrically connected to hoop steel-shaped terminals 21 and 22 by soldering, welding, or other suitable method, the air-core coil 1 is placed in the mold. Next, after the mold has been filled with the magnetic powder the surface of which is coated with at least two types of resin layers, as described in the first preferred embodiment, a molded body 25 in which the air-core coil 1 is embedded is formed by pressing and molding the magnetic powder, as shown in FIG. 6. The hoop steel-shaped terminals 21 and 22 are led out of the side surface of the molded body 25.

Next, the molded body 25 is heat treated to produce a magnetic body 25*a*. Then, the hoop steel-shaped terminals 21 and 22 are formed to a desired shape. Thus, in a choke coil 30, since a thermosetting resin having a mechanical strength that is greater than a thermoplastic resin of the outer layer is used for the inner layer of the resin layers with which the surface of the magnetic powder is coated, even if the molding pressure increases at the time of molding and heat-treatment is performed after the molding, the inner resin layer does not break down and outstanding insulation between magnetic particles (the resistivity is $10^5$ Ω·cm or more) is provided. Moreover, since an oxide film is provided at the interface between the magnetic powder and the resin layers, the insulation between magnetic particles is further improved. As a result, the hoop steel-shaped terminals 21 and 22 are easily embedded in the magnetic body 25*a*, and a high inductance or a low resistance is easily obtained at a low cost.

Moreover, a coil component and a manufacturing method thereof according to the present invention are not limited to the above-described preferred embodiments, and various changes and modifications may be made without departing from the scope and spirit of the invention. For example, the resin layers are not limited to a two-layer construction. A three-layer construction in which another intermediate resin layer is provided between the inner layer and the outer layer may be used, or a construction in which another resin is provided inside the inner layer and/or outside the outer layer may be used.

Furthermore, the coil component is not limited to a configuration in which an air-core coil is embedded in a magnetic body, and the coil component may be one of various types shown in FIGS. 8 to 12. In a coil component 40 shown in FIG. 8, E-core magnetic bodies 41 and 42 and a coil 44 wound on the core portion of a bobbin 43 are provided. In a coil component 50 shown in FIG. 9, a toroidal magnetic body 51 and a coil 52 wound on the magnetic body 51 are provided. In a coil component 60 shown in FIG. 10, pot-core magnetic bodies 61 and 62 and a coil 63 wound on the rod portion of the magnetic body 62 are provided.

Figure 11:
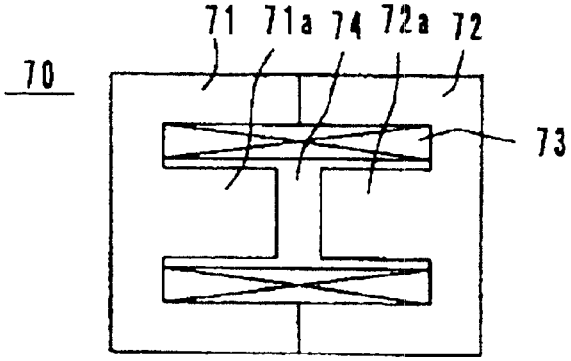
FIG. 11 is a perspective view showing a coil component of another preferred embodiment according to the present invention.
Figure 12:
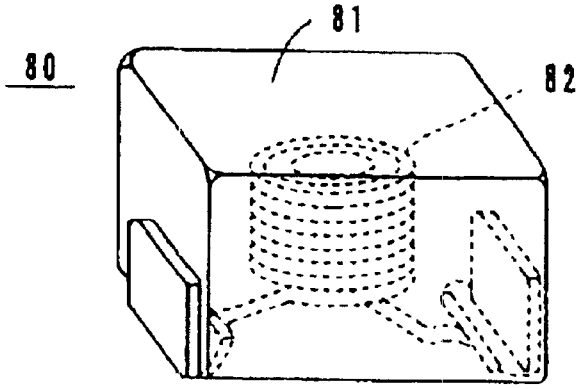
FIG. 12 is a perspective view showing a coil component of another preferred embodiment according to the present invention.

Furthermore, in a coil component 70 shown in FIG. 11, two magnetic bodies 71 and 72 are provided, the middle leg portions 71*a* and 72*a* of the magnetic bodies 71 and 72 are inserted in a solenoid 73, and an air gap 74 is provided between the leg portions 71*a* and 72*a*. In a coil component 80 shown in FIG. 12, an air-core coil 82 is embedded in a magnetic body 81.

These magnetic bodies 41, 42, 51, 61, 62, 71, 72, and 81 may be also molded by using a magnetic powder that is coated with at least two types of resin layers.

As clearly understood from the above description, according to the present invention, since the magnetic body is molded using a magnetic powder that is coated with at least two types of resin layers, even if the molding pressure is increased at the time of molding and heat-treatment is performed after the molding, the inner resin layer does not break down and the outstanding insulation between magnetic particles is achieved by using, for example, a thermosetting resin having a high mechanical strength for the inner resin layer. Furthermore, the insulation between magnetic particles is further improved by providing an oxide film at the interface between the resin layers and the magnetic powder.

On the other hand, by using, for example, a thermoplastic resin for the outer resin layer, the outer resin layer is temporarily melted in the heat-treatment after the molding and is then solidified again, the bonding strength between magnetic particles is greatly increased, and the space between magnetic particles is greatly decreased. As a result, the mechanical strength of the magnetic body and the weather resistance thereof is greatly improved.

Furthermore, by using a thermosetting resin for the outer resin layer that is different from that for the inner layer, the outer layer which is not initially hardened is completely hardened by heat-treatment after the molding, the bonding strength between magnetic particles is greatly increased, and the space between magnetic particles is greatly decreased. As a result, the mechanical strength of the magnetic body is greatly increased.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A coil component comprising:

a magnetic body including magnetic powder, a surface of said magnetic powder being coated with at least two types of resin layers; and a coil defined by a conductor having an insulating film provided thereon, at least a portion of the coil being embedded in the magnetic body; wherein an inner layer of the at least two types of resin tavern is made of a thermosetting resin.

2. A coil component as set forth in claim 1, wherein the magnetic powder is a magnetic metal powder.

3. A coil component as set forth in claim 2, wherein the magnetic metal powder includes pure iron particles having an average particle size of about 20 $\mu$m or less.

4. A coil component as set forth in claim 1, wherein an outer layer of the at least two types of resin layers is made of a thermoplastic resin.

5. A coil component as set forth in claim 1, wherein an outer layer of the at least two types of resin layers is made of a thermosetting layer which has a different composition from that of the inner layer.

6. A coil component as set forth in claim 1, wherein an oxide film is provided at an interface between the at feast two types of resin layers and the magnetic powder.

7. A coil component as set forth in claim 1, wherein a coating material is provided on the surface of the magnetic body.

8. A coil component as set forth in claim 7, wherein the coating material is made of one of resin and grass.

9. A coil component as set forth in claim 4, wherein the thermosetting resin is a thermosetting fluororesin, and the thermoplastic resin is a thermoplastic polyimide resin.

10. A coil component as set forth in claim 1, wherein an outer layer of the at least two types of resin layers is thinner than an inner layer of the at least two types of resin layers.

* * * * *